US010626536B2

(12) United States Patent
Hanada

(10) Patent No.: US 10,626,536 B2
(45) Date of Patent: Apr. 21, 2020

(54) FOOT-OPERATED CONTROLLER OF SEWING MACHINE

(71) Applicant: JUKI CORPORATION, Tama-shi, Tokyo (JP)

(72) Inventor: Tsuyoshi Hanada, Tama (JP)

(73) Assignee: JUKI CORPORATION, Tokyo (JP)

( * ) Notice: Subject to any disclaimer, the term of this patent is extended or adjusted under 35 U.S.C. 154(b) by 58 days.

(21) Appl. No.: 16/117,114

(22) Filed: Aug. 30, 2018

(65) Prior Publication Data

US 2019/0062973 A1 Feb. 28, 2019

(30) Foreign Application Priority Data

Aug. 31, 2017 (JP) ..... 2017-166316

(51) Int. Cl.
*D05B 69/18* (2006.01)
*D05B 69/08* (2006.01)
*D05B 37/04* (2006.01)

(52) U.S. Cl.
CPC ..... *D05B 69/08* (2013.01); *D05B 37/04* (2013.01); *D05B 69/18* (2013.01)

(58) Field of Classification Search
CPC . D05B 69/18; G05G 1/36; G05G 1/40; Y10T 74/20888
See application file for complete search history.

(56) References Cited

U.S. PATENT DOCUMENTS 3,253,562 A * 5/1966 Hedegaard ..... D05B 69/22 112/275
3,327,662 A * 6/1967 Ahate ..... D05B 75/02 112/217.3
4,354,071 A * 10/1982 Pietschmann ..... H01H 21/26 200/86.5
5,067,368 A * 11/1991 Itakura ..... D05B 69/18 112/271
5,253,545 A * 10/1993 Barrons ..... D05B 69/18 74/512
5,351,571 A * 10/1994 Johnson ..... G05G 1/36 74/478
5,587,634 A * 12/1996 Desai ..... D05B 69/18 318/257
2012/0060734 A1* 3/2012 Yamanashi ..... D05B 69/18 112/275

FOREIGN PATENT DOCUMENTS

JP H10-118380 A 5/1998

* cited by examiner

*Primary Examiner* — Tajash D Patel
(74) *Attorney, Agent, or Firm* — Faegre Drinker Biddle & Reath LLP

(57) ABSTRACT

A foot-operated controller of a sewing machine including a first pedal that input a number of revolution of a sewing machine motor by stepping of a user, a second pedal pressed by the user, a main body that supports the first pedal, and a support unit that supports the second pedal, in which the support unit is selectively attachable in disposition where the second pedal is on the left side of the first pedal and disposition where the second pedal is on the right side of the first pedal. In both cases where the second pedal is on the left side of the first pedal and the right side of the first pedal, across an interval between the main body and the support unit, it is possible to detect the pressing to the second pedal with respect to the second element.

8 Claims, 9 Drawing Sheets

FOOT-OPERATED CONTROLLER OF SEWING MACHINE

CROSS-REFERENCE TO RELATED APPLICATION

The present application claims priority from Japanese Patent Application No. 2017-166316 filed on Aug. 31, 2017, the entire content of which is incorporated herein by reference.

TECHNICAL FIELD

The present invention relates to a foot-operated controller of a sewing machine.

BACKGROUND ART

A foot-operated controller of a sewing machine of the related art includes a control pedal that drives a sewing machine motor and a thread cutting pedal that executes thread cutting provided next to a foot pedal (for example, the left side), and the control pedal and the thread cutting pedal are provided in one housing (for example, refer to JP-A-10-118380).

When performing sewing, a user steps the control pedal and drives the sewing machine motor to execute the sewing, and when it is necessary to perform the thread cutting, the user releases the foot from the control pedal and operates the thread cutting pedal.

Incidentally, although an input of any of the control pedal and the thread cutting pedal is performed by the foot, whether or not it becomes easier to perform the operation when the thread cutting pedal is provided on either the left side or the right side with respect to the control pedal, depends on each user of the sewing machine.

Corresponding thereto, a foot-operated controller having a configuration in which the control pedal and the thread cutting pedal are provided in separate housings and the housing of the thread cutting pedal can be attached to either the left side or the right side of the housing of the control pedal, can also be considered.

However, when the control pedal and the thread cutting pedal are provided in separate housings, it is necessary to input a signal from an element that detects an operation of the control pedal and a signal from an element that detects an operation of the thread cutting pedal into a control device of the sewing machine, and thus, each of a signal transmission cable that extends from the housing of the control pedal and a signal transmission cable that extends from the housing of an input switch is necessarily connected to the sewing machine, and there is a concern that a problem that preparation work before the sewing becomes complicated.

SUMMARY

The present invention has been made in view of the above circumstances, and an aspect of the present invention provides a foot-operated controller that makes preparation work before sewing easy and includes at least one of features of the following (1) to (4).

(1) A foot-operated controller of a sewing machine includes a first pedal, a second pedal, a main body and a support unit. The first pedal that input a number of revolution of a sewing machine motor along with displacement of a position of the first pedal by stepping of a user. The second pedal that input a specific instruction along with a pressing of the user. The main body that supports the first pedal to be capable of displacing the position. The support unit that supports the second pedal to be capable of being pressed. The support unit is selectively attachable with respect to the main body in disposition where the second pedal is on the left side of the first pedal and disposition where the second pedal is on the right side of the first pedal. The main body holds a first element that detects the displacement of the first pedal and a second element that detects the pressing of the second pedal. The support unit is equipped with a transmission member that performs an advancing and retracting movement in conjunction with the pressing of the second pedal. The main body is equipped with a switch link that performs an input with respect to the second element in conjunction with the advancing and retracting movement of the transmission member. In both cases where the second pedal is on the left side of the first pedal and where the second pedal is on the right side of the first pedal, across an interval between the main body and the support unit, the switch link performs the input to allow the second element to detect the pressing to the second pedal.

(2) The foot-operated controller of the sewing machine according to (1), a front part and a rear part of the second pedal have a symmetrical shape, and a front part and a rear part of the support unit have a symmetrical shape.

(3) The foot-operated controller of the sewing machine according to (1) or (2) further includes an attachable and detachable structure that is provided to allow the support unit to be mountable thereon, between the main body and support unit, in both cases where the second pedal is on the left side of the first pedal and where the second pedal is on the right side of the first pedal, by fitting of a recess portion and a projection portion.

(4) The foot-operated controller of the sewing machine according to any one of (1) to (3) further includes a partition portion that is provided on a second pedal side of the first pedal and that projects from a tread of the first pedal.

In the present invention, the support unit is equipped with the transmission member which advances and retracts in conjunction with the pressing of the second pedal, the main body is equipped with the switch link that performs the input with respect to the second element in conjunction with an advancing and retracting movement of the transmission member, and even in any of the disposition in which the second pedal is on either the left side of the first pedal or the right side of the first pedal, between the main body and the support unit, it is possible to allow the second element to detect the pressing to the second pedal.

Accordingly, it becomes possible to detect the pressing of the second pedal in a state where the second element is provided in the main body, and there is no need to equip the main body and the support unit separately with the first element and the second element, and thus, one cable drawn out from the main body may be connected to the sewing machine side, and it becomes possible to easily perform preparation work before the sewing.

BRIEF DESCRIPTION OF THE DRWING

DETAILED DESCRIPTION

[Overall Configuration of Example of Foot-Operated Controller of Sewing Machine]

Hereinafter, an example of a foot-operated controller of a sewing machine according to the present invention will be described in detail with reference to the drawings. The foot-operated controller 1 of the sewing machine according to the present invention is a foot-operated controller for increasing and decreasing the number of revolution (rotation speed) of the sewing machine motor and for inputting execution of thread cutting as a specific instruction.

Figure 1:
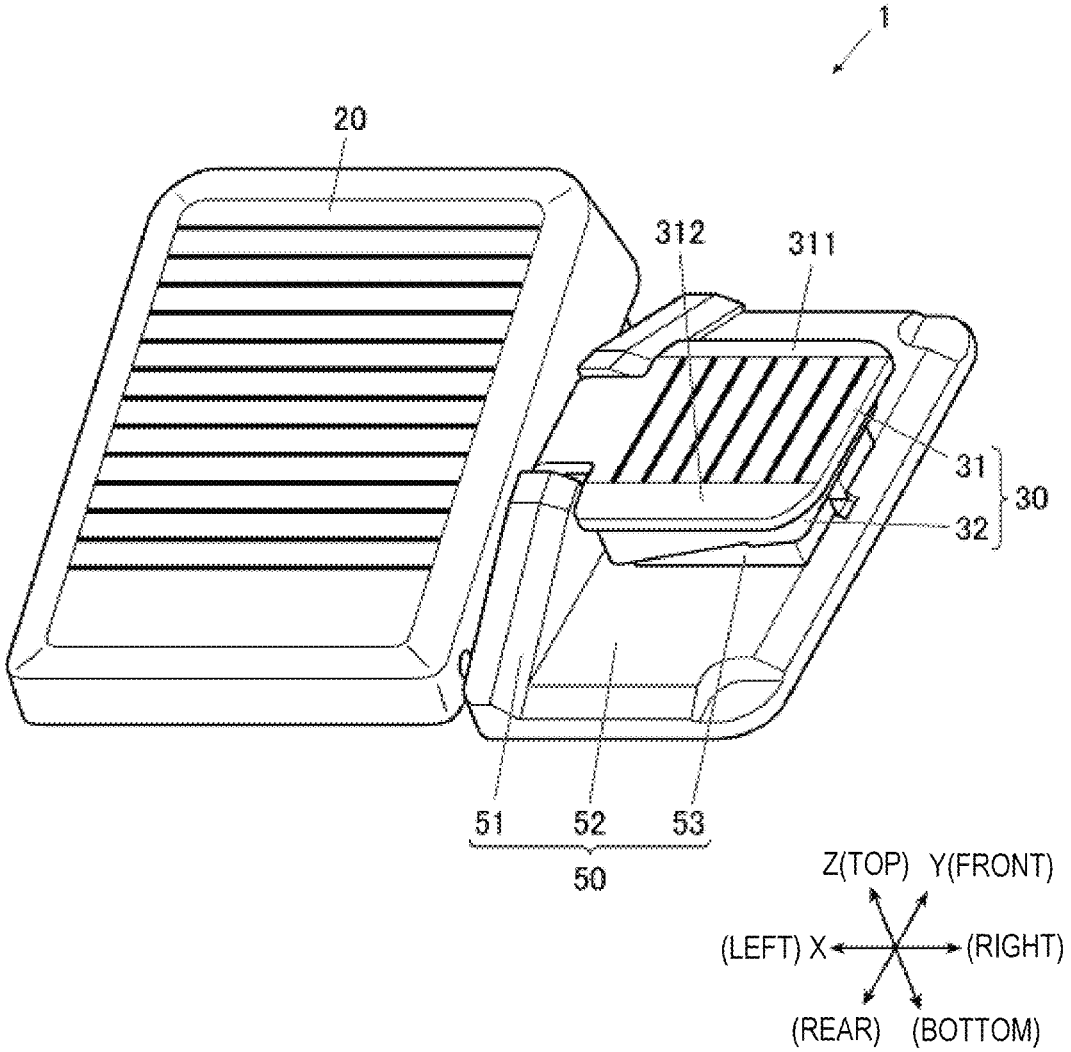
FIG. 1 is a perspective view of a foot-operated controller of a sewing machine as an embodiment of the present invention.
Figure 2:
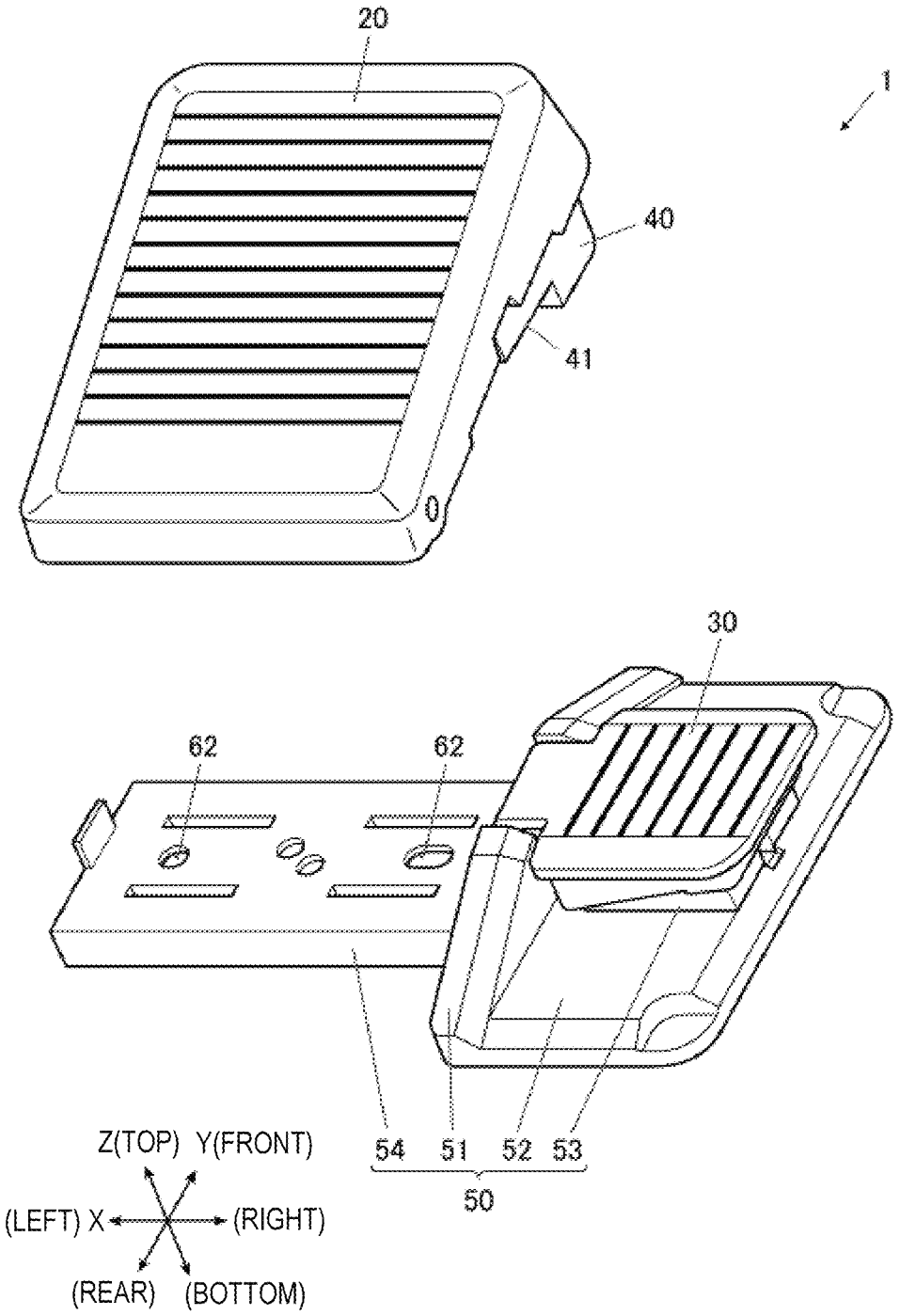
FIG. 2 is an exploded perspective view of the foot-operated controller.

FIG. 1 is a perspective view of a foot-operated controller 1 of the sewing machine of the present invention, and FIG. 2 is an exploded perspective view thereof.

As illustrated in FIGS. 1 and 2, the foot-operated controller 1 of the sewing machine includes: a control pedal 20 (first pedal) of which a position is displaced by rotation according to a stepping amount of the user; a thread cutting pedal 30 (second pedal) in which a pressing is performed by the user; a main body 40 that supports the control pedal 20 to be rotatable; and a support unit 50 that supports the thread cutting pedal 30 to be capable of performing the pressing.

In addition, all of the members are made of plastic or the like.

In a state where the foot-operated controller 1 is placed on a horizontal plane, a direction which is a horizontal direction and in which the main body 40 and the support unit 50 are aligned is an X-axis direction, a direction which is a horizontal direction and is orthogonal to the X-axis direction is a Y-axis direction, and a direction orthogonal to the X-axis direction and the Y-axis direction is a Z-axis direction. In addition, as illustrated in FIG. 1, one side of the X-axis directions is "left" and the other side is "right", one side of the Y-axis directions is "front" and the other side is "rear", and one side of the Z-axis direction is "top", and the other side is "bottom".

[Control Pedal]

The control pedal 20 is a member for the user to step on to increase or decrease the number of revolution (rotation speed) of the sewing machine motor. In addition, the control pedal 20 is configured with a rectangular parallelepiped housing of which the inside is hollow and a bottom portion is opened.

An upper surface of the control pedal 20 is a tread on which the stepping is performed and the upper surface has a substantially rectangular shape. A long side thereof is along the Y-axis direction and a short side thereof is along the X-axis direction. Furthermore, the control pedal 20 is disposed on the upper side of the main body 40 in a state where the front end portion side is biased upward and the upper surface thereof is inclined forward and obliquely upward, and the rear end portion thereof is supported by the main body 40 to be rotatable around the X-axis. In addition, a plurality of slip-proof grooves along the X-axis direction are formed side by side substantially on the entire upper surface of the control pedal 20.

In other words, rotation is performed by stepping against the biasing force from a state where the upper surface of the control pedal 20 is inclined forward and obliquely upward, and as a rotation angle amount (displacement amount) increases, the operation input amount of the number of revolution of the sewing machine motor also increases.

[Main Body]

The main body 40 includes a rectangular parallelepiped housing of which the inside is hollow and the upper portion is opened, and on the inside thereof, a sliding type variable resistor 71 that serves as a first element that electrically detects displacement of the control pedal 20, and a microswitch 72 that serves as a second element that electrically detects an instruction input of thread cutting with respect to the thread cutting pedal 30, and the like, are stored.

The main body 40 has a rectangular shape slightly smaller than the control pedal 20 in a plan view, and has an exact size that can be accommodated inside the control pedal 20.

In addition, a recessed groove 41 is formed over the entire width in the X-axis direction in the bottom portion of the main body 40, and the width in the Y-axis direction and the depth in the Z-axis direction of the recessed groove 41 are uniform over the entire length. In addition, the support unit 50 is attachable to and detachable from the recessed groove 41 from either the right side or the left side. The attaching structure of the support unit 50 with respect to the recessed groove 41 will be described later.

[Thread Cutting Pedal]

As described above, the thread cutting pedal 30 and the support unit 50 are attachable to and detachable from either the right side or the left side of the main body 40.

Figure 3:
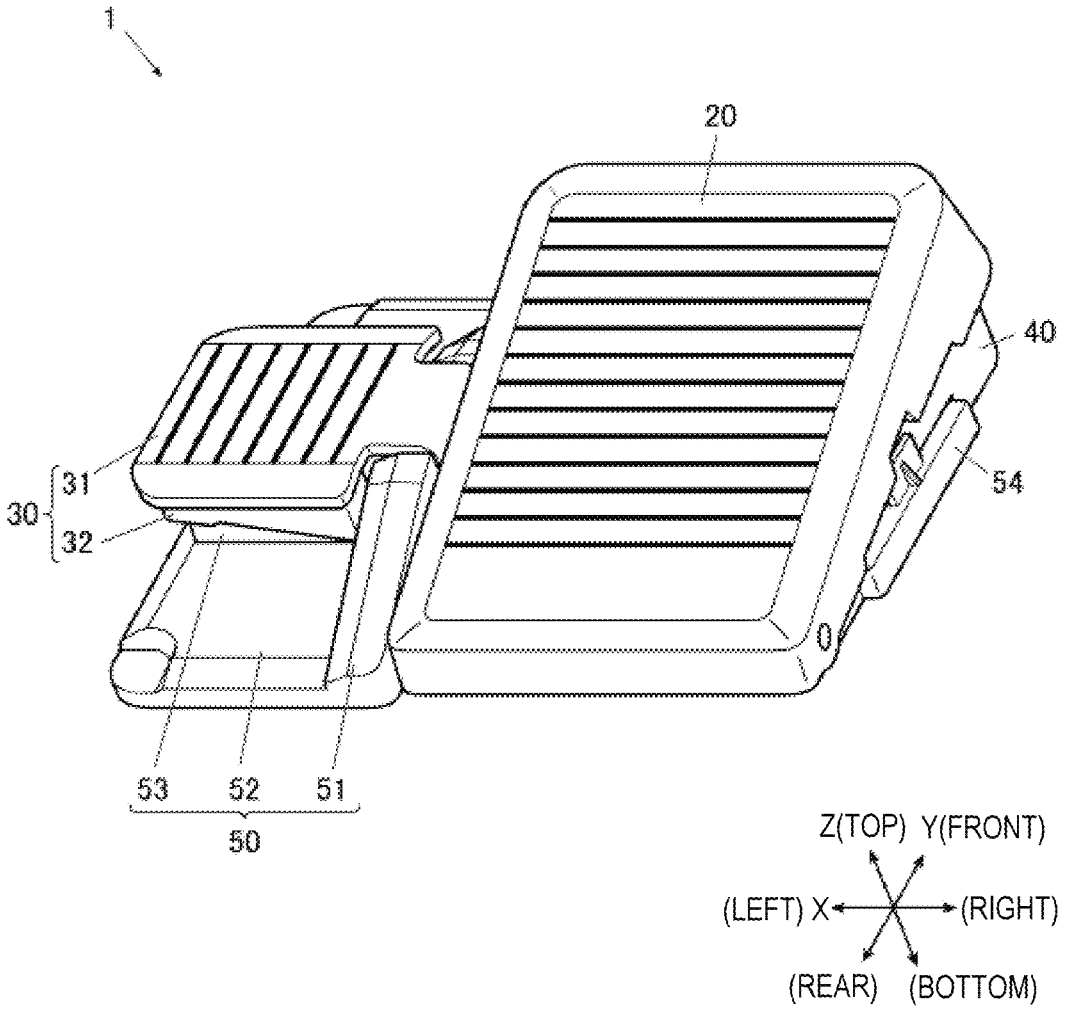
FIG. 3 is a perspective view of the foot-operated controller of the sewing machine in which disposition of thread cutting pedal is changed to the left side.

In addition, FIG. 1 illustrates a state where the thread cutting pedal 30 and the support unit 50 are attached to the right side of the main body 40, and FIG. 3 illustrates a state where the thread cutting pedal 30 and the support unit 50 are attached to the left side of the main body 40.

In a case where the thread cutting pedal 30 and the support unit 50 are attached to the right side of the control pedal 20, the thread cutting pedal 30 is oriented to be positioned on the right side of the main body 40, and in a case where the thread cutting pedal 30 and the support unit 50 are attached to the left side of the control pedal 20, the thread cutting pedal 30 is oriented to be positioned on the left side of the main body 40 by rotating by 180° around the Z-axis.

In the following description, in a case where there is no particular notice, assuming that the thread cutting pedal 30 and the support unit 50 are attached to the right side of the control pedal 20, the disposition and the orientation of each portion of the thread cutting pedal 30 and the support unit 50 will be described.

The thread cutting pedal 30 is a member for performing the pressing with a foot such that the user causes a sewing machine to execute thread cutting, and a top plate portion 31 onto which the pressing is performed and a side wall portion 32 in a shape of a rectangular frame on the lower surface side of the top plate portion 31 are integrally formed.

In other words, the side wall portion 32 includes side walls that surround four sides, such as the front, rear, left, and right sides, the upper portion thereof is closed by the top plate portion 31, and the lower portion thereof is opened.

The top plate part 31 has a substantially rectangular shape with the long side along the Y-axis direction and the short side along the X-axis direction. In addition, the left end portion of the top plate portion 31 has a slightly narrower width in the Y-axis direction, and the left end portion is supported by the support unit 50 so as to be rotatable around the Y-axis. In other words, the thread cutting pedal 30 rotates as a whole by the pressing from the user, and the input is performed by lowering the right end portion thereof.

In addition, in the front end portion on the upper surface of the top plate portion 31, a tapered portion 311 inclined forward obliquely downward is provided substantially over the entire width in the X-axis direction, and in the rear end portion on the top surface of the top plate portion 31, a tapered portion 312 inclined rearward obliquely downward is provided substantially over the entire width in the X-axis direction.

In addition, a plurality of slip-proof grooves along the Y-axis direction are formed side by side substantially on the entire upper surface excluding the tapered portions 311 and 312 of the thread cutting pedal 30.

[Support Unit]

The support unit 50 includes: a support wall 51 that stands upright along a Y-Z plane and supports the thread cutting pedal 30 to be rotatable; a horizontal support plate 52 that extends rightward from the lower end portion of the support wall 51; a storage unit 53 that stores a connecting link 81 and a linear motion link 82 which will be described later on the upper surface of the support plate 52; and an insertion unit 54 that extends leftward from the support wall 51, and the members are integrally formed.

The longitudinal direction of the support wall 51 is along the Y-axis direction, the central portion thereof is recessed in a recessed shape, the left end portion of the thread cutting pedal 30 is fitted into the recess, and the thread cutting pedal 30 is supported to be rotatable.

The support plate 52 is a flat plate along the X-Y plane and is positioned below the thread cutting pedal 30. The support plate 52 extends slightly rightward from the right end portion of the thread cutting pedal 30 and is longer than the thread cutting pedal 30 in the front-rear direction.

The storage unit 53 includes side wall portions that surround four sides, such as the front, rear, left, and right sides, the lower portion thereof is closed by the support plate 52, and the upper portion thereof is opened. In addition, the storage unit 53 has a rectangular shape slightly smaller than the side wall portion 32 of the thread cutting pedal 30 in a plan view and has a size that can be accommodated inside the side wall portion 32.

The insertion unit 54 is a plate-like member that extends leftward from the left surface lower end portion of the support wall 51 and is elongated along the X-axis direction, and the width in the Y-axis direction and the thickness in the Z-axis direction are uniform over the entire length.

In addition, the width in the Y-axis direction and the thickness in the Z-axis direction of the insertion unit 54 substantially match the width in the Y-axis direction and the depth in the Z-axis direction of the recessed groove 41 formed in the bottom portion of the main body 40 (strictly speaking, the width and the thickness are slightly smaller than the width and depth of the recessed groove 41), the insertion unit 54 can be inserted from below the recessed groove 41.

In addition, the insertion unit 54 is not limited to a state where the insertion unit 54 is oriented leftward (a state where the thread cutting pedal 30 is disposed on the right side of the control pedal 20), and can be inserted from below the recessed groove 41 even in a state where the insertion unit 54 is oriented rightward (a state where the thread cutting pedal 30 is disposed on the left side of the control pedal 20).

The thread cutting pedal 30 and the support unit 50 are symmetrical with respect to the front-rear direction, that is, the outer shape of the front part and the rear part is a symmetrical shape, in a state where the thread cutting pedal 30 is attached to the support unit 50. Therefore, even in a case where the thread cutting pedal 30 and the support unit 50 are mounted on either the right side or the left side of the main body 40, the thread cutting pedal 30 is positioned in the same disposition, and the same shape of the thread cutting pedal 30 appears on the user side, and thus, even in a case where the thread cutting pedal 30 is disposed on either the left side or the right side with respect to the control pedal 20, it is possible to maintain uniform operability without deviation.

[Attachable and Detachable Structure of Main Body and Support Unit]

Figure 4A:
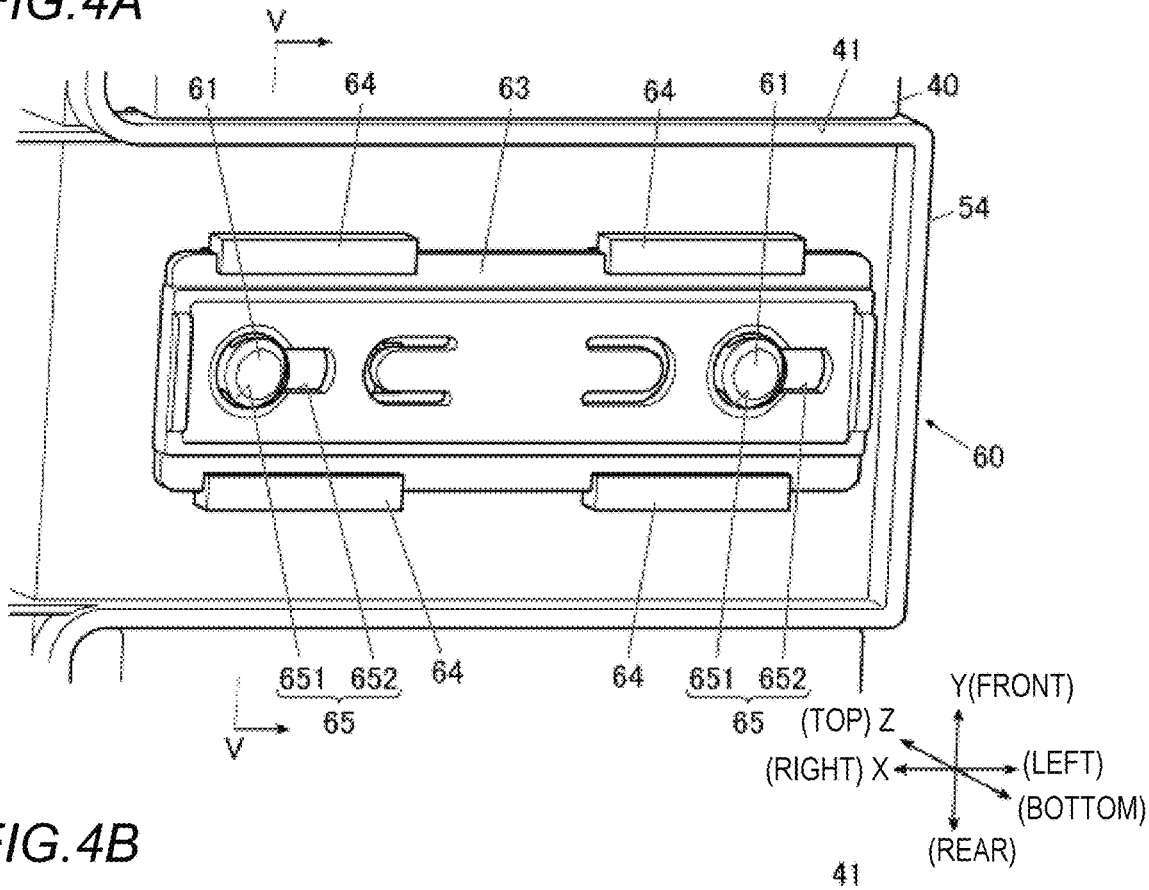
FIG. 4A is a perspective view of an attachable and detachable structure illustrating a state before an operation of a slide plate.
Figure 4B:
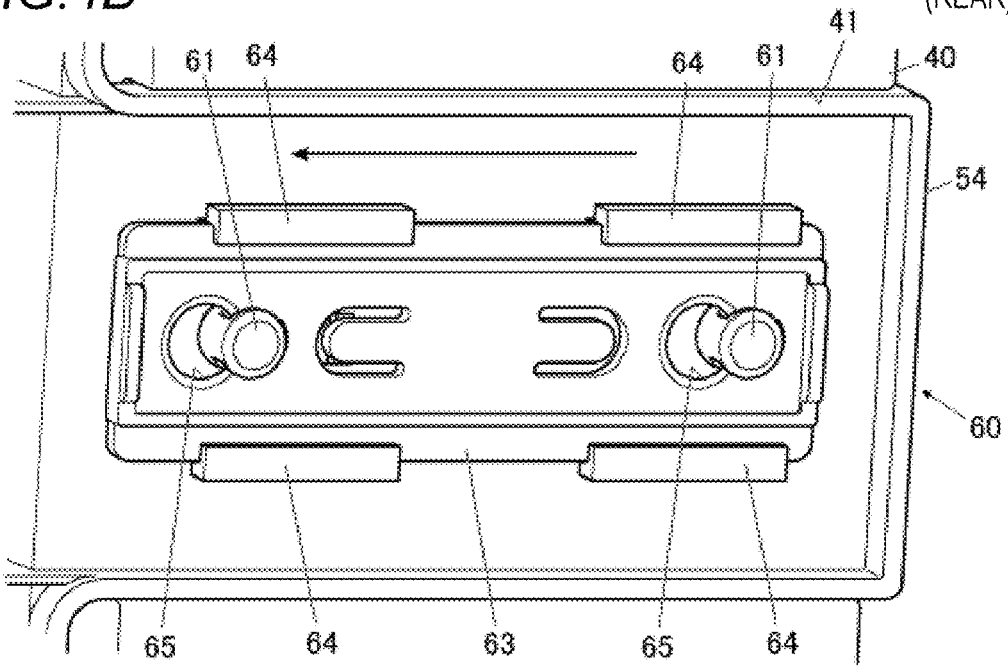
FIG. 4B is a perspective view of the attachable and detachable structure illustrating a state after the operation of the slide plate.
Figure 5A:
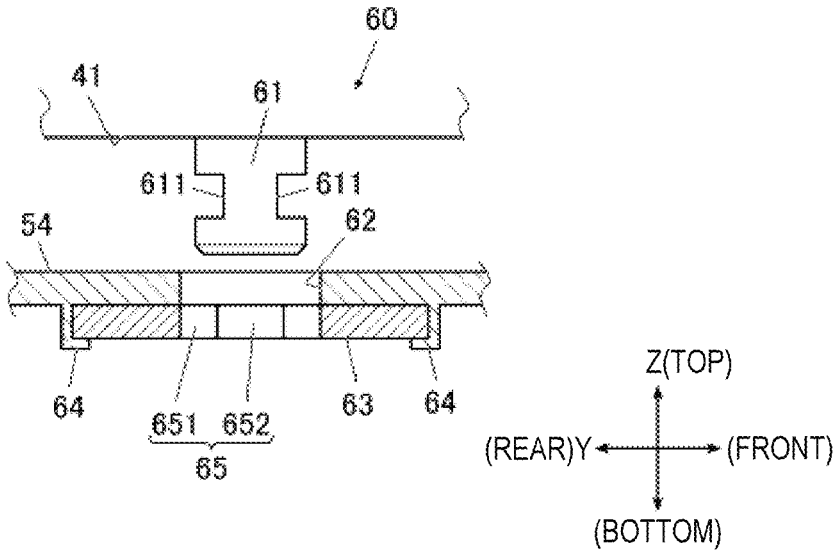
FIG. 5A is a sectional view taken along line V-V in FIG. 4A illustrating a state before a projection is inserted into an insertion hole.
Figure 5B:
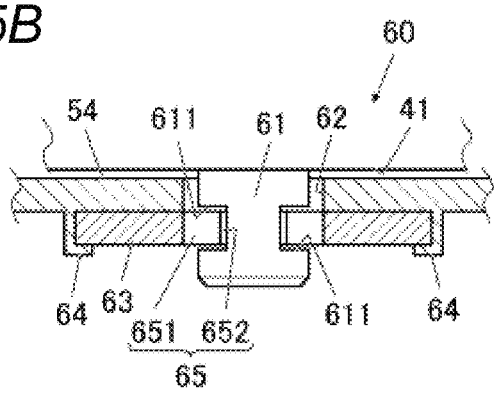
FIG. 5B is a sectional view illustrating a state where the projection is inserted in the insertion hole.

FIGS. 4A and 4B are perspective views of an attachable and detachable structure 60, and FIGS. 5A and 5B are sectional views.

Between the recessed groove 41 of the main body 40 and the insertion unit 54 of the support unit 50, provided is the attachable and detachable structure 60 for attaching and detaching the support unit 50 to and from either the left side or the right side of the main body 40 by making the recess portion and the projection portion fit to each other.

The attachable and detachable structure 60 includes two cylindrical projections 61 provided on the bottom surface of the recessed groove 41, insertion holes 62 (refer to FIG. 2) that penetrate vertically through the insertion unit 54 and into which the projections 61 can be inserted, and a slide plate 63 that holds the projection 61 inserted into the hole 62 so as not to come out.

Two projections 61 are provided side by side along the X-axis direction on the bottom surface of the recessed groove 41, and are disposed so that the distance from the left end portion of the recessed groove 41 to the projection 61 on the left side and the distance from the right end portion of the recessed groove 41 to the projection 61 are equal to each other.

Two insertion holes 62 into which the projections 61 are respectively inserted are formed side by side along the X-axis direction in the insertion unit 54. The distance between the insertion holes 62 is equal to the interval between the two projections 61.

In other words, the support unit 50 can insert and mount the two projections 61 into and on the two insertion holes 62, regardless of the thread cutting pedal 30 oriented to the right side or the left side.

In addition, since the distance from the left end portion of the recessed groove 41 to the projection 61 on the left side and the distance from the right end portion of the recessed groove 41 to the projection 61 on the right side are equal to each other, in a case where the support unit 50 is attached to the main body 40 in a state where the thread cutting pedal 30 is oriented to the right side and a case where the support unit 50 is attached to the main body 40 in a state where the thread cutting pedal 30 is oriented to the left side, the disposition of the thread cutting pedal 30 is symmetrical in the left-right direction, and even in a case of either the left side or the right side, it is possible to maintain uniform operability without deviation.

The insertion unit 54 has a thinned structure on the bottom surface side, has a recessed shape at the upper part thereof except an outer edge portion of the insertion unit 54, and on the inside thereof, a slide plate 63 is provided.

The slide plate 63 has an elongated flat plate shape, and the longitudinal direction extends along the X-axis direction.

Furthermore, the slide plate 63 is slidably supported along the longitudinal direction in the bottom portion of the insertion unit 54 by a slide support unit 64 of which both end portions in the lateral direction have an L-shaped cross-section.

In addition, at each position of the slide plate 63 that corresponds to the two insertion holes 62 of the insertion unit 54, a lock hole 65, including a circular portion 651 of which an inner diameter is equal to that of the insertion hole 62 and a slit portion 652 that extends leftward being connected to the circular portion 651, is formed penetrating the slide plate 63. In addition, since it is enough when both slit portions 652 of the two lock holes 65 extend in the same direction on either the right side or the left side, both slit portions 652 may be formed to be oriented rightward.

The width in the Y-axis direction of the slit portion 652 is narrower than the diameter of the circular portion 651 of each lock holes 65.

On the other hand, as illustrated in FIGS. 5A and 5B, in each projection 61, a groove 611 along the X-axis direction is formed at a position slightly above the lower end portion thereof and on both sides in the Y-axis direction at an outer circumference thereof. In the projection 61, the width in the Y-axis direction at the position at which the two grooves 611 are formed is slightly narrower than the width of the slit portion 652.

The two projections 61 in the recessed groove 41 of the main body 40 are inserted into the two insertion holes 62 of the insertion unit 54 from above, are further inserted into the circular portions 651 of the two lock holes 65 of the slide plate 63 (refer to FIGS. 4A and 5B), and then, the slide plate 63 is slid rightward. Accordingly, the edge portion of the slit portion 652 of the lock hole 65 enters the groove 611 of each projection 61, each projection 61 is constrained in the Z-axis direction, and the support unit 50 can be fixedly mounted to the main body 40 (refer to FIG. 4B).

When the slide plate 63 is slid leftward again, the constrained state of each projection 61 is released, and the support unit 50 can be separated from the main body 40.

Incidentally, in a case where the support unit 50 is mounted such that the thread cutting pedal 30 is disposed on the left side of the control pedal 20, the insertion unit 50 is inserted into the recessed groove 41 in a state where the extending end portion of thereof is oriented rightward, can be mounted by sliding the slide plate 63 leftward, and can be separated by sliding the slide plate 63 rightward.

[Internal Configuration of Main Body]

Figure 6A:
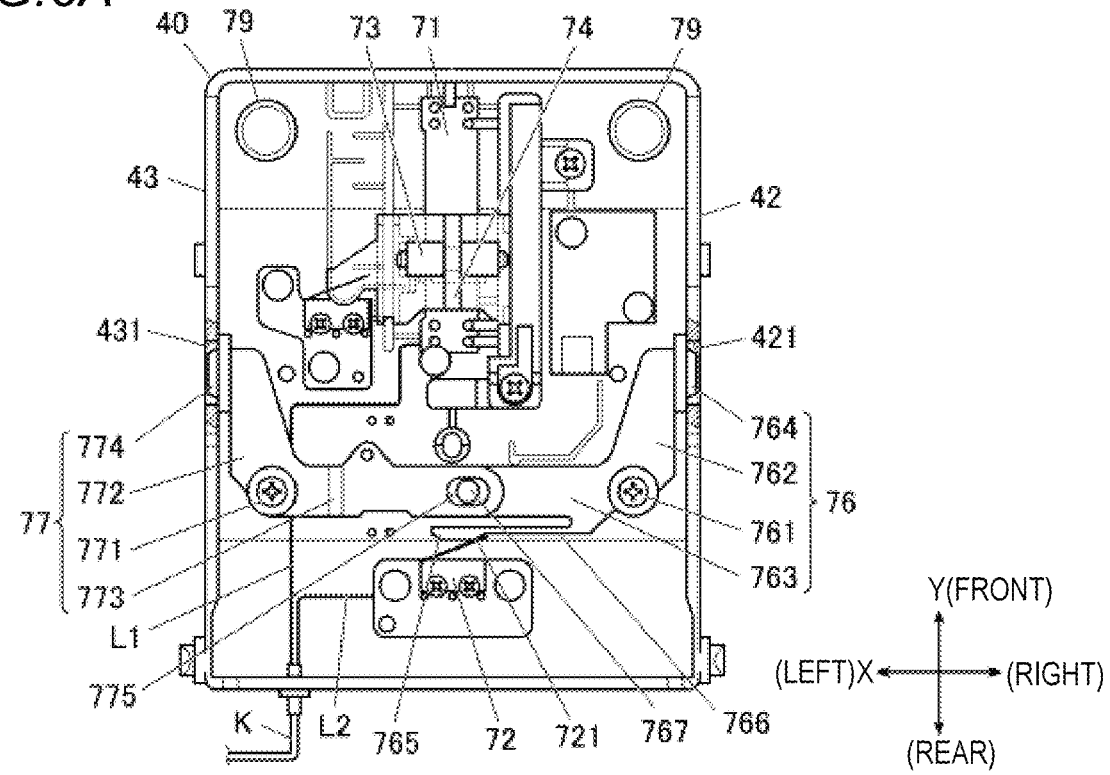
FIG. 6A is a plan view illustrating a main body and an internal configuration thereof.
Figure 6B:
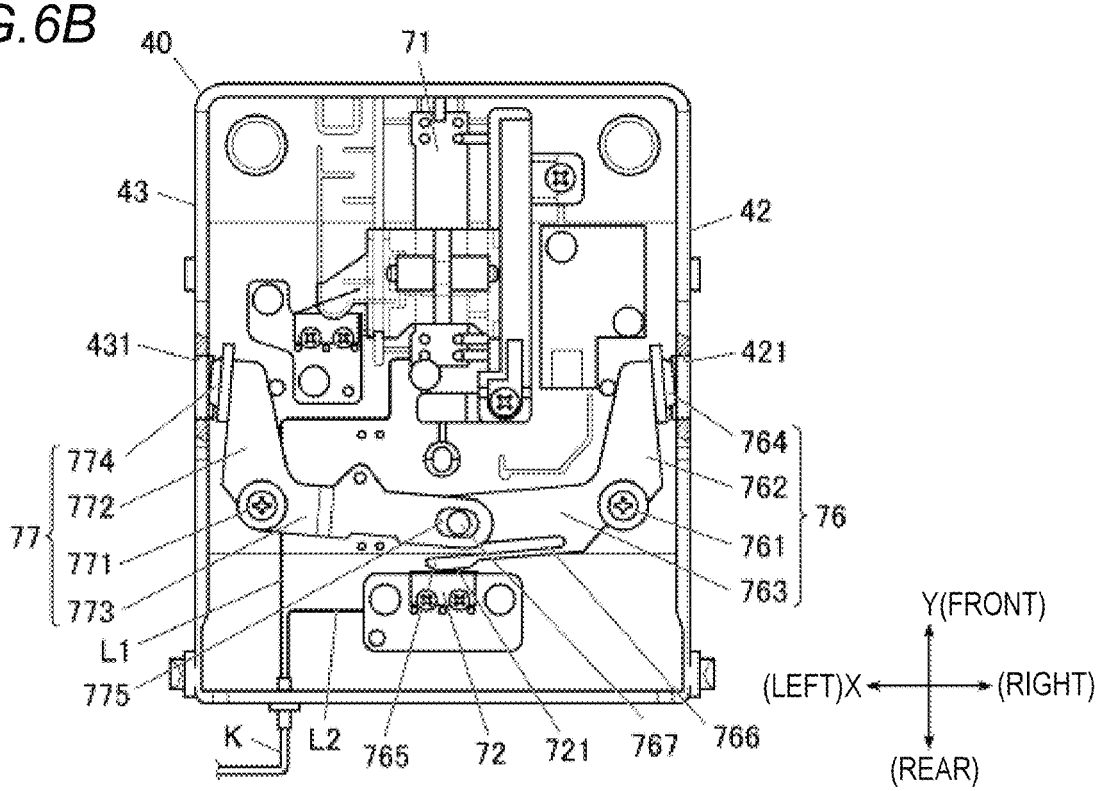
FIG. 6B is a plan view illustrating an operating state of a microswitch which will be described later and stored in the main body.

FIG. 6A is a plan view illustrating the main body 40 and an internal configuration thereof, and FIG. 6B is a plan view illustrating an operating state of the microswitch 72 which will be described later and stored in the main body 40.

As illustrated in FIG. 6A, in the main body 40, provided is a sliding type variable resistor 71 that serves as a first element for detecting the displacement of the control pedal 20, a microswitch 72 that serves as a second element for detecting an instruction input of thread cutting, a roller 73 and a roller base member 74 that transmit the displacement of the control pedal 20 to the sliding type variable resistor 71, a switch link includes a right switch link 76 and a left switch link 77 for causing the microswitch 72 to detect the pressing input to the thread cutting pedal 30, and coil springs 79 which are elastic bodies repulsive to a stepping of the control pedal 20.

The coil springs 79 are provided along the Z-axis direction at two locations, such as the left front end portion and the right front end portion inside the main body 40. Each upper end portion of the coil springs 79 abuts against the bottom surface of the control pedal 20 and gives an upward repulsive force to the stepping of the control pedal 20.

A resistance value of the sliding type variable resistor 71 increases and decreases when the position of a sliding unit (not illustrated) moves along the Y-axis direction. In a case where the foot-operated controller 1 is connected to the sewing machine, the resistance value of the sliding type variable resistor 71 is detected on the sewing machine side, and control for determining the rotation speed of the sewing machine motor is performed according to the resistance value.

The roller base member 74 is slidable in the Y-axis direction and is connected to the sliding unit of the sliding type variable resistor 71.

The roller base member 74 is equipped with the roller 73 so as to be rotatable around the X-axis.

The roller 73 abuts against an inclined cam (not illustrated) provided on the bottom surface of the control pedal 20. Therefore, when stepping on the control pedal 20, the roller base member 74 is pressed by the inclined cam and moves forward via the roller 73, and the sliding unit of the connected sliding type variable resistor 71 slides and moves forward. Accordingly, since the resistance value of the sliding type variable resistor 71 varies according to the stepping amount of the control pedal 20, the stepping amount of the control pedal 20 can be detected from the resistance value of the sliding type variable resistor 71 on the sewing machine side.

The microswitch 72 is disposed in the inner rear portion of the main body 40 and includes an input unit 721 which rotates in the front-rear direction. In addition, in a case where the foot-operated controller 1 is connected to the sewing machine, when the input unit 721 of the microswitch 72 is pressed rearward and rotated, a closed state is achieved, and the state can be detected as an instruction input of thread cutting on the sewing machine side.

Since either the sliding type variable resistor 71 or the microswitch 72 is disposed in the main body 40, a wiring L1 for transmitting and receiving a signal between the sliding variable resistor 71 and the sewing machine and a wiring L2 for transmitting and receiving a signal between the microswitch 72 and the sewing machine can be arranged in one cable K.

The right switch link 76 has a bell crank shape and is pivotally supported so as to be rotatable around the Z-axis with respect to the main body 40 by a step screw 761, and an input arm 762 that extends forward and an output arm 763 that extends leftward from the position of being pivotally supported are provided.

In addition, as illustrated in FIG. 6A, a passive projection 764 that protrudes rightward is formed at a rotation end portion of the input arm 762, and the passive projection 764 is inserted from the left side into an opening portion 421 formed to penetrate a right side wall 42 of the main body 40. In addition, the passive projection 764 is set to have a protruding length that does not protrude to the outside (right side) of the opening portion 421.

In addition, an interlocking projection 767 for rotating in conjunction with the left switch link 77 and an active projection 765 that protrudes rearward are formed at the rotation end portion of the output arm 763 of the right switch link 76.

The active projection 765 abuts against the input unit 721 of the microswitch 72 from the front.

The active projection 765 is supported by the output arm 763 via a leaf spring 766 that bends in the front-rear direction.

When the above-described passive projection 764 is pressed leftward from the outside of the opening portion 421, the right switch link 76 rotates in a counterclockwise direction when viewed from above, the active projection 765 presses the input unit 721 of the microswitch 72 rearward, and a closed state can be achieved.

The left switch link 77 has a bell crank shape and is pivotally supported so as to be rotatable around the Z-axis with respect to the main body 40 by a step screw 771, and an input arm 772 that extends forward from the position of being pivotally supported and an output arm 773 that extends rightward are provided.

In addition, as illustrated in FIG. 6A, a passive projection 774 that protrudes leftward is formed at a rotation end portion of the input arm 772, and the passive projection 774 is inserted from the right side into an opening portion 431 formed to penetrate a left side wall 43 of the main body 40. In addition, the passive projection 774 is set to have a protruding length that does not protrude to the outside (left side) of the opening portion 431.

In addition, an elongated through-hole 775 is formed to penetrate in the top-bottom direction at the rotation end portion of the output arm 773 of the left switch link 77, and the interlocking projection 767 of the right switch link 76 is loosely inserted from below.

Therefore, when the above-described passive projection 774 is pressed rightward from the outside of the opening portion 431, the left switch link 77 rotates in a clockwise direction when viewed from above, and the right switch link 76 interlockingly rotates in the counterclockwise direction via the through-hole 775 and the interlocking projection 767. Accordingly, the active projection 765 presses the input unit 721 of the microswitch 72 rearward and the closed state can be achieved.

In addition, an elastic force is applied to the left switch link 77 so as to be rotated in the counterclockwise direction by a spring (not illustrated), and the right switch link 76 and the left switch link 77 are maintained in a state where the microswitch 72 is not closed as long as an external force is not received.

[Internal Configuration of Storage Unit of Support Unit]

Figure 7A:
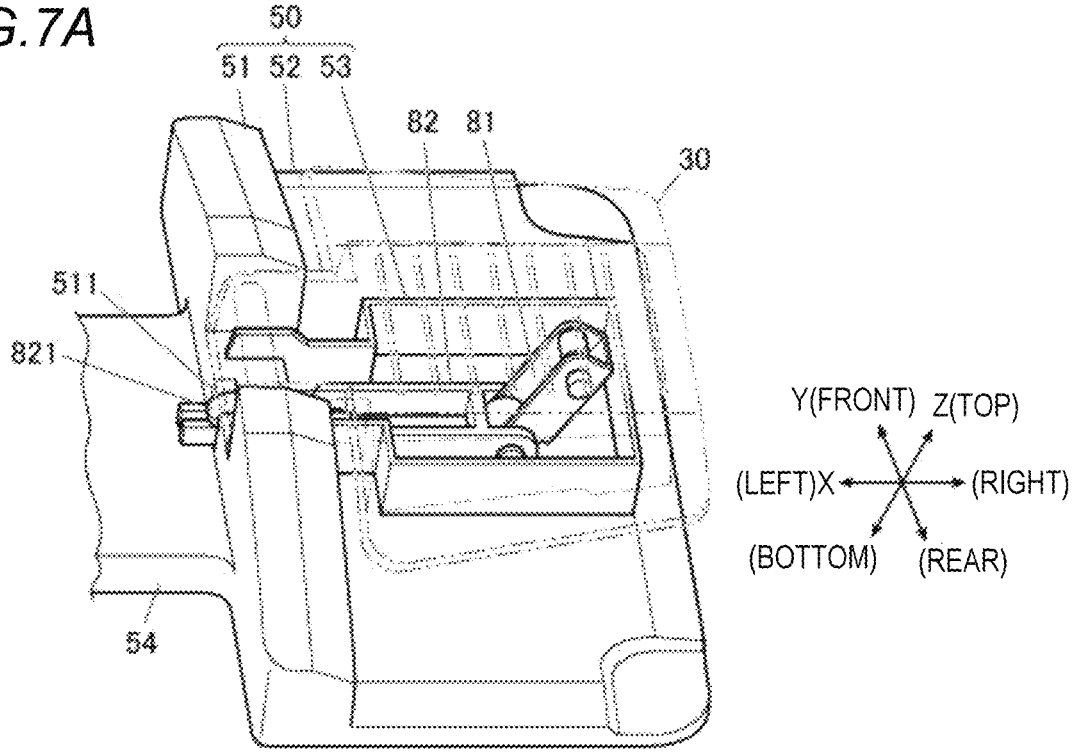
FIG. 7A is a perspective view illustrating an internal configuration of a storage unit of a support unit.
Figure 7B:
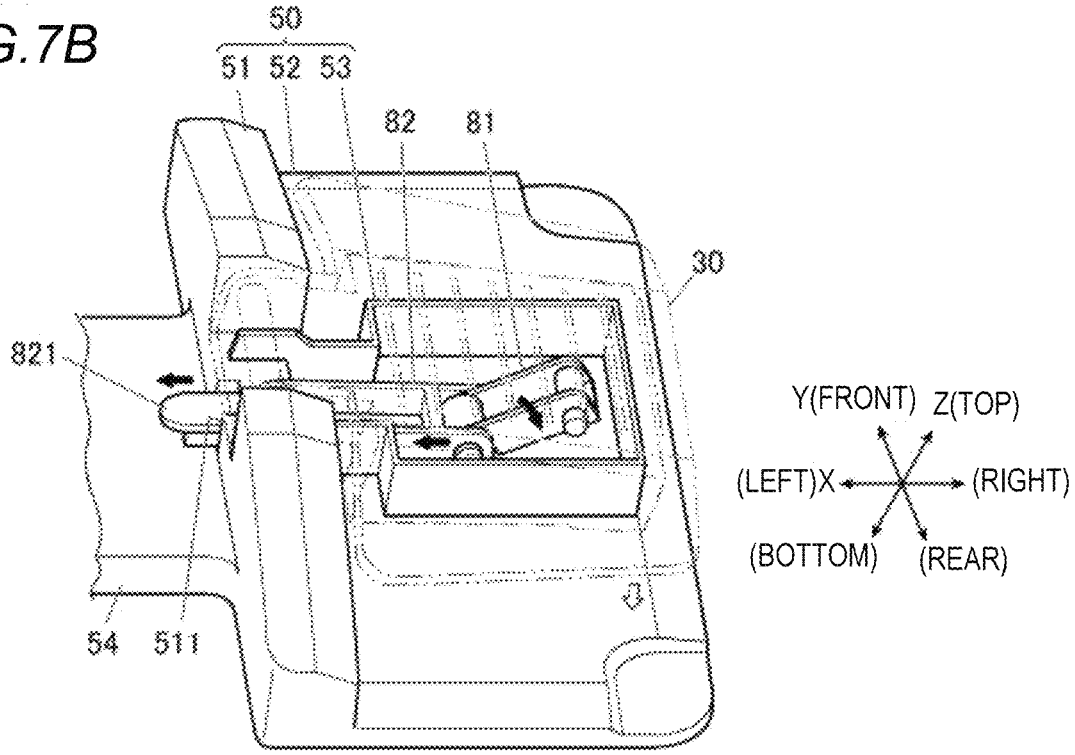
FIG. 7B is a perspective view of the internal configuration of the storage unit in a state where a pressing of the thread cutting pedal is performed.

FIG. 7A is a perspective view illustrating an internal configuration of the storage unit 53 of the support unit 50, and FIG. 7B is a perspective view of the internal configuration of the storage unit 53 in a state where the pressing of the thread cutting pedal 30 is performed.

In the storage unit 53, the connecting link 81 and a linear motion link 82 that serve as transmission members for interlockingly performing the advancing and retracting movement by the pressing of the thread cutting pedal 30 are stored.

One end portion of the connecting link 81 is connected to the bottom surface side of the thread cutting pedal 30 to be rotatable around the Y-axis, and the other end portion is connected to one end portion (right end portion) of the linear motion link 82 to be rotatable around the Y-axis.

The linear motion link 82 is disposed along the X-axis direction and is supported to be slidable along the X-axis direction in the storage unit 53.

Meanwhile, since the connecting link 81 is disposed in a state of being inclined along the right obliquely upward direction, when one end portion of the connecting link 81 is pressed downward by the pressing of the thread cutting pedal 30, as illustrated in FIG. 7B, as the one end portion of the connecting link 81 moves downward and the other end portion of the connecting link 81 moves leftward, and accordingly, the linear motion link 82 also moves leftward as a whole.

The other end portion (left end portion) of the linear motion link 82 includes an operation piece 821 formed in an elongated flat plate shape along the X-Y plane, and is disposed in an opening portion 511 that penetrates from the left end portion of the storage unit 53 to the left surface of the support wall 51.

In a state where the thread cutting pedal 30 is not pressed, as illustrated in FIG. 7A, the tip end portion of the operating piece 821 of the linear motion link 82 retracts into the opening portion 511, and when the thread cutting pedal 30 is pressed, as illustrated in FIG. 7B, the tip end portion of the operation piece 821 protrudes leftward from the opening portion 511.

In a state where the support unit 50 is attached such that the thread cutting pedal 30 is positioned on the right side of the control pedal 20, the opening portion 511 of the support wall 51 is disposed to be close to and oppose the opening portion 421 of the right side wall 42 of the main body 40. Therefore, when the tip end portion of the operating piece 821 protrudes leftward from the opening portion 511 by the pressing of the thread cutting pedal 30, since the tip end portion is inserted into the opening portion 421 and the passive projection 764 of the right switch link 76 in the main body 40 is pressed leftward, the right switch link 76 rotates in the counterclockwise direction around the step screw 761 and the microswitch 72 goes into the closed state by the active projection 765.

In addition, the relative disposition of the opening portion 421 with respect to the recessed groove 41 in a case where the right side wall 42 of the main body 40 is viewed from the right side and the relative disposition of the opening portion 431 with respect to the recessed groove 41 in a case where the left side wall 43 of the main body 40 is viewed from the left side match each other.

Therefore, in a case where the support unit 50 is attached such that the thread cutting pedal 30 is positioned on the left side of the control pedal 20, the opening portion 511 of the support wall 51 is disposed to be close to and oppose the opening portion 431 of the left side wall 43 of the main body 40. Therefore, when the tip end portion of the operating piece 821 protrudes rightward from the opening portion 511 by the pressing of the thread cutting pedal 30, since the tip end portion is inserted into the opening portion 431 and the passive projection 774 of the left switch link 77 in the main body 40 is pressed rightward, the left switch link 77 rotates in the clockwise direction around the step screw 771, the right switch link 76 rotates in the counterclockwise direction around the step screw 761 via the interlocking projection 767, and the microswitch 72 goes into the closed state by the active projection 765.

[Usage of Foot-Operated Controller]

A usage of the foot-operated controller 1 will be described.

In a case of placing the thread cutting pedal 30 on the right side of the control pedal 20, in a state where the insertion unit 54 of the support unit 50 is oriented leftward, the two projections 61 are inserted into the two insertion holes 62, and the slide plate 63 is slid rightward (refer to FIGS. 4A and 4B). Accordingly, the edge portion of the slit portion 652 of the slide plate 63 enters the groove 611 of each projection 61, and the support unit 50 is fixedly mounted to the main body 40.

In addition, when the cable K of the foot-operated controller 1 is connected to the sewing machine and the control pedal 20 is stepped, the sewing machine motor starts driving and the sewing is started, and at the same time, the position of the sliding unit of the sliding type variable resistor 71 moves according to the stepping amount of the control pedal 20, the resistance value that corresponds to the stepping amount is detected by the sewing machine, and the number of revolution of the sewing machine motor is controlled.

In addition, when the thread cutting pedal 30 is pressed, the connecting link 81 and the linear motion link 82 are operated, the tip end portion of the operating piece 821 of the linear motion link 82 protrudes leftward from the opening portion 511, the passive projection 764 of the right switch link 76 in the opening portion 421 is pressed leftward, and accordingly, the microswitch 72 goes into the closed state. Accordingly, on the sewing machine side, the thread cutting pedal 30 can detect the pressing and thread cutting is executed.

In addition, in a case of disposing the thread cutting pedal 30 on the left side of the control pedal 20, in a state where the insertion unit 54 of the support unit 50 is oriented rightward, the two projections 61 are inserted into the two insertion holes 62, and the slide plate 63 is slid leftward. Accordingly, the support unit 50 is fixedly mounted to the main body 40 (refer to FIG. 2).

In addition, when the cable K of the foot-operated controller 1 is connected to the sewing machine and the control pedal 20 is stepped, the resistance value that corresponds to the stepping amount is detected on the sewing machine side by the sliding type variable resistor 71, and the number of revolution of the sewing machine motor is controlled.

In addition, when the thread cutting pedal 30 is pressed, the connecting link 81 and the linear motion link 82 are operated, the tip end portion of the operating piece 821 of the linear motion link 82 protrudes rightward from the opening portion 511, the passive projection 774 of the left switch link 77 in the opening portion 431 is pressed rightward, and accordingly, the microswitch 72 goes into the closed state. Accordingly, on the sewing machine side, a thread cutting instruction signal is detected and the thread cutting is executed.

The foot-operated controller 1 passes through the opening portion 421 or 431 provided in the main body 40 in conjunction with the pressing of the thread cutting pedal 30, the storage unit 53 of the support unit 50 is equipped with the linear motion link 82 that advances and retracts in conjunction with the pressing of the thread cutting pedal 30 across the interval between the main body 40 and the support unit 50, and the main body 40 is equipped with the right switch link 76 and the left switch link 77 which rotate by the advancing and retracting movement of the linear motion link 82 and input to the microswitch 72.

Accordingly, it becomes possible to detect the pressing of the thread cutting pedal 30 in a state where the microswitch 72 is provided in the main body 40, the main body 40 is equipped with both the sliding type variable resistor 71 for controlling the number of revolution of the sewing machine motor and the microswitch 72 for the thread cutting signal detection, and thus, one cable K drawn out from the main body 40 may be connected to the sewing machine side, and it becomes easy to perform the preparation before the sewing.

In addition, since the front part and the rear part of the thread cutting pedal 30 and the support unit 50 have a symmetrical shape, in a case where the thread cutting pedal 30 is disposed on the right side of the control pedal 20 and in a case where the thread cutting pedal 30 is disposed on the left side of the control pedal 20, the thread cutting pedal 30 is positioned symmetrically, and the symmetrical shape of the thread cutting pedal 30 appears on the user side, and thus, even in a case where the thread cutting pedal 30 is disposed on either the left side or the right side, it is possible to maintain uniform operability without deviation.

Further, between the main body 40 and the support unit 50, even in either case where the thread cutting pedal 30 is on the left side of the control pedal 20 or the right side of the control pedal 20, due to the fitting of the insertion hole 62 that is a recess portion and the projection 61 that is a projection portion, the attachable and detachable structure 60 is provided for the support unit 50 to be mountable thereon.

Accordingly, it is possible to easily change the disposition of the thread cutting pedal 30 without using a tool, such as a screwdriver.

MODIFIED EXAMPLE

Figure 8:
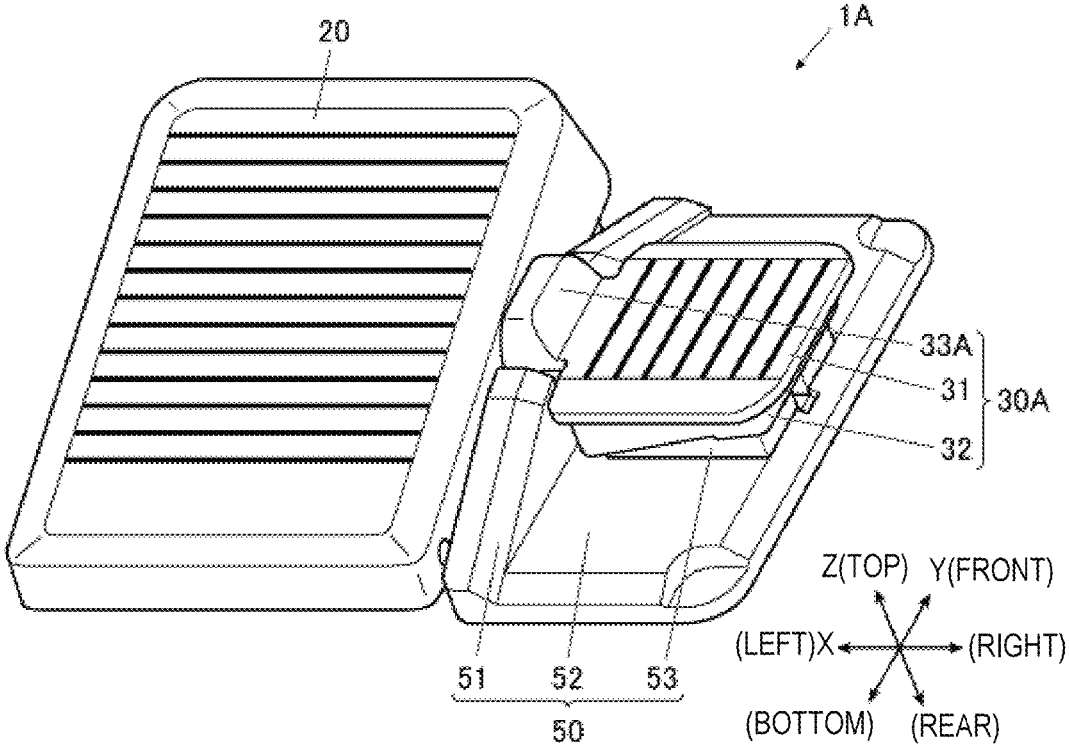
FIG. 8 is a perspective view illustrating a modified example of the foot-operated controller.
Figure 9:
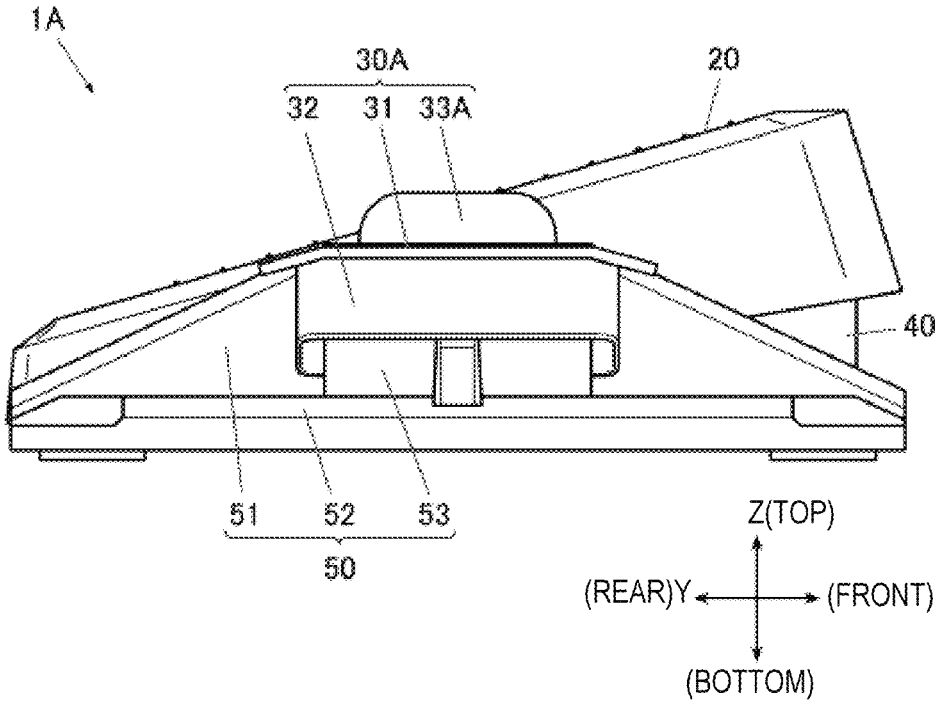
FIG. 9 is a side view of the modified example of the foot-operated controller.

FIG. 8 is a perspective view illustrating a modified example of the foot-operated controller, and FIG. 9 is a side view thereof.

In a foot-operated controller 1A, a partition portion 33A which is a projection with respect to the tread of the control pedal 20 is provided, and since a configuration other than this is the same as that of the above-described foot-operated controller 1, the same reference numerals are given and the overlapping description thereof will be omitted.

In the foot-operated controller 1A, in the left end portion of a thread cutting pedal 30A (on the assumption that the thread cutting pedal 30A is disposed on the right side of the control pedal 20), the projecting stripe partition portion 33A along the Y-axis direction is formed. The partition portion 33A protrudes upward at a height that becomes a projection with respect to the upper surface (tread) of the control pedal 20.

By providing the partition portion 33A, since the user of the sewing machine cannot press the thread cutting pedal 30 unless the foot is once released from the upper surface of the control pedal 20, the operation of the thread cutting pedal 30 can be prevented when the stepping of the control pedal 20 is maintained, and it becomes possible to protect the sewing machine mechanism unit.

In addition, the partition portion 33A may be provided in another member, for example, the support wall 51 of the support unit 50, not being limited to the thread cutting pedal 30A.

Further, since the partition portion 33A is provided on a rotation fulcrum shaft of the thread cutting pedal 30 and is set to have a height that becomes a projection with respect to the upper surface (tread) of the control pedal 20, even when the partition portion 33A is stepped, the thread cutting pedal 30 does not rotate and has a function as a stopper for preventing the control pedal 20 from being stepped mistakenly when operating the thread cutting pedal 30.

[Others]

The specific instruction input from the thread cutting pedal 30 is not limited to the thread cutting instruction. For example, the thread cutting pedal 30 may be used to instruct other functions of the sewing machine.

In addition, although the linear motion link that performs a linear movement and is disposed in the support unit 50 is exemplified as a transmission member, but a member that does not move linearly but rotates may be a transmission member. In this case, it is desirable to provide an operating piece that becomes a projection in a tangential direction of a rotation trajectory of the rotation end portion.

Further, across the interval between the main body 40 and the support unit 50, in order to allow the microswitch 72 to detect the pressing of the thread cutting pedal 30, a case where the linear motion link 82 disposed in the support unit 50 protrudes from the opening portion 511 of the support unit 50 is exemplified, but a configuration in which the linear motion link 82 does not protrude from the opening portion 511 of the support unit 50 is also possible.

For example, the passive projection 764 of the above-described right switch link 76 extends rightward so as to protrude to the outside of the opening portion 421, and similarly, the passive projection 774 of the left switch link 77 extends further leftward so as to protrude to the outside of the opening portion 431.

Furthermore, the length in the longitudinal direction of the operating piece 821 of the linear motion link 82 on the support unit 50 side is shortened, and the operating piece 821 and the passive projection 764 or 774 abut against each other inside the opening portion 511 when the thread cutting pedal 30 is pressed.

In this case, the right switch link 76 and the left switch link 77 disposed on the main body 40 side perform the input for detecting the pressing of the thread cutting pedal 30 with respect to the microswitch 72 through the opening portions 421 and 431 across the interval between the main body 40 and the support unit 50.

In addition, the main body 40 and the support unit 50 may be fixed to each other by screws without providing the slide plate 63.

The invention claimed is:

1. A foot-operated controller of a sewing machine, comprising:

a first pedal that input a number of revolution of a sewing machine motor along with displacement of a position of the first pedal by stepping of a user;

a second pedal that input a specific instruction along with a pressing of the user;

a main body that supports the first pedal to be capable of displacing the position; and a support unit that supports the second pedal to be capable of being pressed, wherein the support unit is selectively attachable with respect to the main body in disposition where the second pedal is on a left side of the first pedal and disposition where the second pedal is on a right side of the first pedal, the main body holds a first element that detects the displacement of the first pedal and a second element that detects the pressing of the second pedal, the support unit is equipped with a transmission member that performs an advancing and retracting movement in conjunction with the pressing of the second pedal, the main body is equipped with a switch link that performs an input with respect to the second element in conjunction with the advancing and retracting movement of the transmission member, and in both cases where the second pedal is on the left side of the first pedal and where the second pedal is on the right side of the first pedal, across an interval between the main body and the support unit, the switch link performs the input to allow the second element to detect the pressing to the second pedal.

2. The foot-operated controller of the sewing machine according to claim 1, wherein a front part and a rear part of the second pedal have a symmetrical shape, and a front part and a rear part of the support unit have a symmetrical shape.

3. The foot-operated controller of the sewing machine according to claim 1, further comprising:

An attachable and detachable structure that is provided to allow the support unit to be mountable thereon, between the main body and support unit, in both cases where the second pedal is on the left side of the first pedal and where the second pedal is on the right side of the first pedal, by a fitting of a recess portion and a projection portion.

4. The foot-operated controller of the sewing machine according to claim 2, further comprising:

an attachable and detachable structure that is provided to allow the support unit to be mountable thereon, between the main body and support unit, in both cases where the second pedal is on the left side of the first pedal and where the second pedal is on the right side of the first pedal, by a fitting of a recess portion and a projection portion.

5. The foot-operated controller of the sewing machine according to claim 1, further comprising:

a partition portion that is provided on a second pedal side of the first pedal and that projects from a tread of the first pedal.

6. The foot-operated controller of the sewing machine according to claim 2, further comprising:

a partition portion that is provided on a second pedal side of the first pedal and that projects from a tread of the first pedal.

7. The foot-operated controller of the sewing machine according to claim 3, further comprising:

a partition portion that is provided on a second pedal side of the first pedal and that projects from a tread of the first pedal.

8. The foot-operated controller of the sewing machine according to claim 4, further comprising:

a partition portion that is provided on a second pedal side of the first pedal and that projects from a tread of the first pedal.

* * * * *